US005305897A

United States Patent [19]

Smith

[11] Patent Number: 5,305,897

[45] Date of Patent: Apr. 26, 1994

[54] WALL MOUNTED SKATEBOARD STORAGE RACK

[76] Inventor: Ronald I. Smith, R.D. #1 - Box 95, Dolgeville, N.Y. 13329

[21] Appl. No.: 996,733

[22] Filed: Dec. 24, 1992

Related U.S. Application Data

[63] Continuation-in-part of Ser. No. 821,607, Jan. 16, 1992.

[51] Int. Cl.[5] ..... A47F 7/00

[52] U.S. Cl. ..... 211/13; 211/87; D6/552; 248/316.8

[58] Field of Search ..... 24/13, 60.1, 87, 18, 24/19; D6/552; 248/316.8

[56] References Cited

U.S. PATENT DOCUMENTS

| | | | |
|---|---|---|---|
| 4,681,233 | 7/1987 | Roth | 211/87 X |
| 4,718,562 | 1/1988 | Winkler | 248/316.8 X |
| 5,097,966 | 3/1992 | Miller | 211/87 |
| 5,203,462 | 4/1993 | Brooks | 211/87 X |

OTHER PUBLICATIONS

"Five Great Sports Hang-Ups", Popular Mechanics, Feb. 1978, pp. 124-125.

*Primary Examiner*—Robert W. Gibson, Jr.
*Attorney, Agent, or Firm*—James P. Hanrath

[57] ABSTRACT

A wall mounted skateboard storage rack comprises a base plate having a back planar surface and a front surface including an upper and lower portion which is provided with a hole or holes, preferably vertically aligned at the horizontal center line of the base plate, that serve as a port or ports for a nail, screw, rivet, lug, pin, or bolt to be inserted therethrough to affix the base plate to a wall, a pair of skateboard support arms located at the upper portion of the base plate front surface which are horizontally aligned from each other in spaced apart relation to receive and support a pair of wheels of a skateboard, and either brace surfaces provided at the outer side end of each skateboard support arm or guide members attached to the base plate at a lower portion thereof and in horizontal alignment from each other in spaced apart relation to receive and secure therebetween a pair of wheels of a skateboard to thereby contain the skateboard in substantially vertical alignment with the base plate.

10 Claims, 3 Drawing Sheets

WALL MOUNTED SKATEBOARD STORAGE RACK

This is a continuation-in-part of Design application Ser. No. 07/821,607, filed Jan. 16, 1992.

BACKGROUND OF THE INVENTION

1. Field of the Invention

The present invention relates generally to a wall mounted skateboard support rack for storage of skateboards in a vertical position adjoining a wall.

2. Description of the Related Art Including Information Disclosed Under 37 CFR § 1.97-1.99

Heretofore, it has been regarded as desirable to safely store away skateboards not in use or to provide apparatus for holding and carrying skateboards.

An example of an apparatus to store away a skateboard is U.S. Pat. No. 4,773,239 to Lowe et al. which discloses a combination skateboard lock and trick device designed for mounting to a skateboard in order to lock the skateboard to a fixed structure such as a bicycle rack or post. The device comprises a lock body member which is fixedly mounted between the board of the skateboard and one of the wheel truck assemblies, the lock body being provided with a pair of oppositely disposed longitudinal bars to receive leg members of an adjustable U-shape shackle, the looped end of which is bent at right angles to the legs thereof, thereby forming a trick handle.

Apparatus for holding and carrying skateboards have heretofore aided skateboard users in transporting their skateboards.

In U.S. Pat. No. 5,016,794 to Beagle, Jr. there is disclosed a backpack for holding and carrying a skateboard which includes a flexible frame for receiving and holding a skateboard and a harness connected to the frame for securing the rigid frame to the back of a user.

In U.S. Pat. No. 4,790,460 to Harper, Jr. discloses a skateboard carrier for mounting on the back of a user which leaves use of the hands free. The skateboard carrier includes a flexible resiliently deformable pad body with front and back faces configured to cover substantially the upper back of the bearer. The lateral sides of the pad body have pairs of attachment members to which cinching straps removably attach across the back face to cinchingly loop around the axle support brackets of a skateboard vertically orientated and positioned with its wheels extending outwardly. The lateral edges of the pad body at the attachment member and the attachment members are drawn tightly against the lateral margins to restrain lateral movement of the skateboard, vertical movement of which is restrained by the loops about the axle support bracket. A plurality of lateral attachment member pairs permits vertical adjustment of the board on the pad body and supplementarily provides for attachment of skateboarding accessory articles. Compact articles may be accommodated in a back face pocket.

In U.S. Pat. No. 4,337,883 to Pate there is disclosed a skateboard holder which can be removably attached to the belt of a wearer for transporting a skateboard. The skateboard holder comprises a rectangularly-shaped hanger, formed of a flat material such as leather, in which two vertically orientated slits are formed in an upper portion thereof for attachment to a belt. Attached to two side portions of the hanger are two straps having fastening means at their ends so that a loop defined by the straps and hanger can be formed. The straps are formed so that each one attaches to the hanger along a predetermined length of a vertical edge thereof. Each strap tapers down so that its end portion is narrower than the predetermined length. A vertically oriented skateboard having its upper wheels extending outwardly is positioned against the hanger so that a loop formed by the two straps is under the outwardly extending upper wheels, thereby providing support for the skateboard as it is transported. In a further embodiment of the invention, a single strap extending from one side portion of the holder is provided. The end portion of the single strap is attached to the other side of the hanger so as to form a loop for holding the skateboard as in the first embodiment.

U.S. Pat. No. 258,703 to Ogle et al. discloses a carrying case for a skateboard including a zippered case for receipt of a skateboard and an adjustable strap fastened to the case.

The present invention provides for a wall mounted storage rack for skateboards to thereby store skateboards not in use at a specific location wherein the skateboard is stored vertically aligned to a wall to avoid the same being left in horizontal orientation which may constitute a hazard or obstacle to people.

SUMMARY OF THE INVENTION

According to the present invention there is provided a wall mounted skateboard storage rack comprising a base plate having a back planar surface and a front surface including an upper and lower portion, means for connecting the base plate to a wall, a pair of skateboard wheel support arms located at the upper portion of the base plate front surface and horizontally aligned from each other in spaced apart relation to receive and support a pair of wheels of a skateboard, and means for containing the skateboard in substantially vertical alignment with the base plate. The wall mounted skateboard storage rack may be provided with a plurality of holes, preferably vertically aligned at a horizontal mid-point of the base plate, that serve as ports for a nail, screw, rivet, lug, pin, or bolt to be inserted therethrough to affix the base plate to a wall. Means for containing the skateboard in substantially vertical alignment with the base plate may include a pair of guide members attached to the lower portion of the base plate in spaced apart relation or each of the skateboard wheel support arms having a brace surface at their outer side ends to receive and secure a pair of wheels of a skateboard therebetween.

DESCRIPTION OF THE PREFERRED EMBODIMENTS

Figure 1:
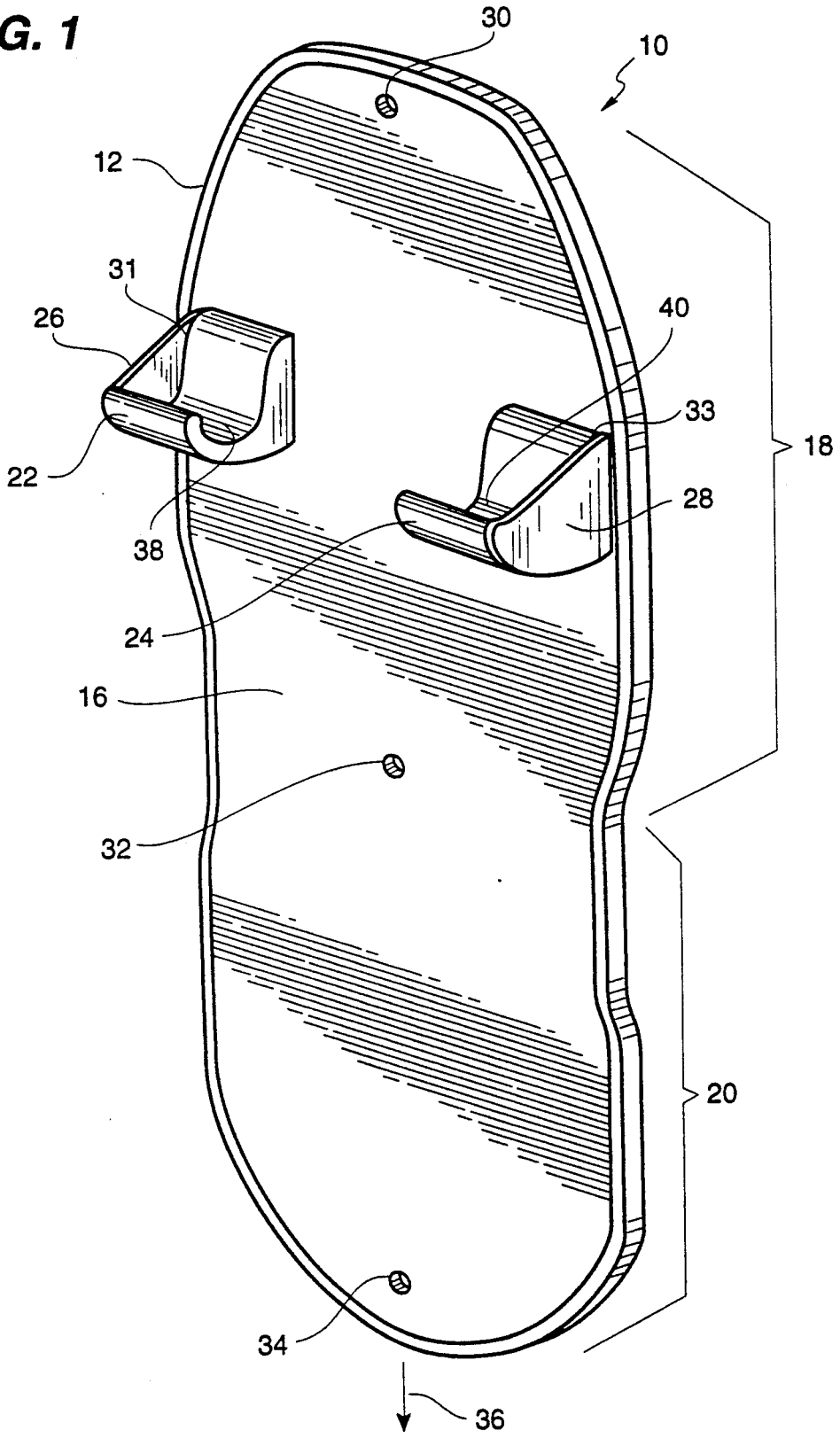
FIG. 1 of the drawings is a frontal perspective view of the wall mounted skateboard storage rack of the present invention and shows a base plate shaped in the form of a skateboard with a pair of skateboard wheel support arms located at an upper portion thereof which are horizontally aligned from each other in spaced apart relation to receive and support a pair of wheels of a skateboard, each of the support arms having a brace surface at their outer side end to maintain the skateboard in substantially vertical alignment with the base plate.
Figure 3:
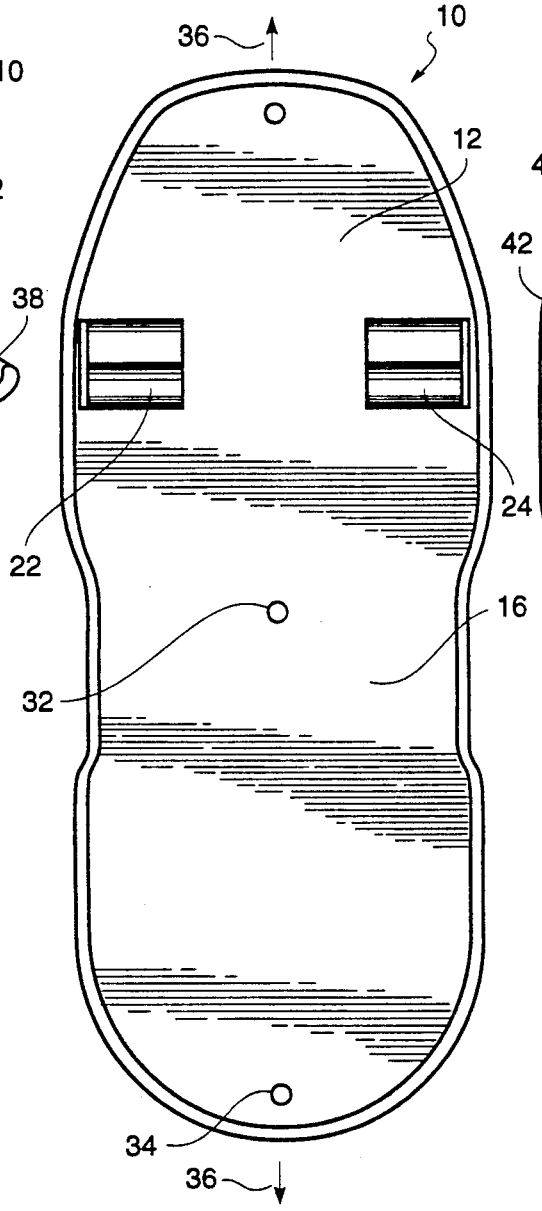
FIG. 3 of the drawings is a front plan view of the wall mounted skateboard storage rack of FIG. 1.

Referring now to the drawings in greater detail, there is illustrated in FIGS. 1 and 3 frontal views of a wall mounted skateboard storage rack 10 of the present invention which includes a base plate 12 having a back planar surface 14 (illustrated at FIG. 4) and front surface 16 including an upper portion 18 and a lower portion 20. A pair of skateboard wheel support arms 22 and 24 are located at the upper portion 18 of the base plate 12 and are horizontally aligned from each other in spaced apart relation to correspond to and receivingly support a pair of wheels of a skateboard to be mounted thereon. Each of the skateboard wheel support arms 22 and 24 have a brace surface 26 and 28, respectively, located at support arm outer side ends 31 and 33 respectively. Brace surfaces 26 and 28 serve to maintain a skateboard in substantially vertical alignment with the base plate 12 when wheels of the skateboard are set into the pair of skateboard wheel support arms 22 and 24.

Skateboard storage rack 10 further includes either a hole 32 at a horizontal center line 36 of base plate 12 or a plurality of holes 30, 32, and 34 vertically aligned along the horizontal center line 36 of base plate 12 which serve as a port or ports for nails, screws, rivets, lugs, pins, or bolts to be inserted therethrough and into a wall to affix base plate 12 to the wall.

As observed in FIG. 1, skateboard wheel support arms 22 and 24 located at upper portion 18 of base plate 12 have a concave wheel receiving upper surface 38 and 40 respectively that are shaped to receive and support the curved surface of a pair of wheels of a skateboard.

Figure 2:
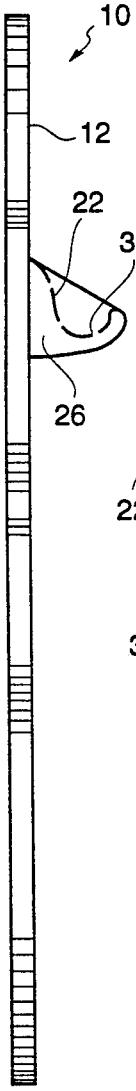
FIG. 2 of the drawings is a side view of the wall mounted skateboard storage rack of FIG. 1.

FIG. 2 of the drawing is a side view of the wall mounted skateboard storage rack 10 and shows support arm 22 attached to base plate 12. Brace surface 26 located at outer side end 30 of wheel support arm 22 extends outwardly from base plate 12 across concave wheel receiving upper surface 38 of support arm 22.

Figure 4:
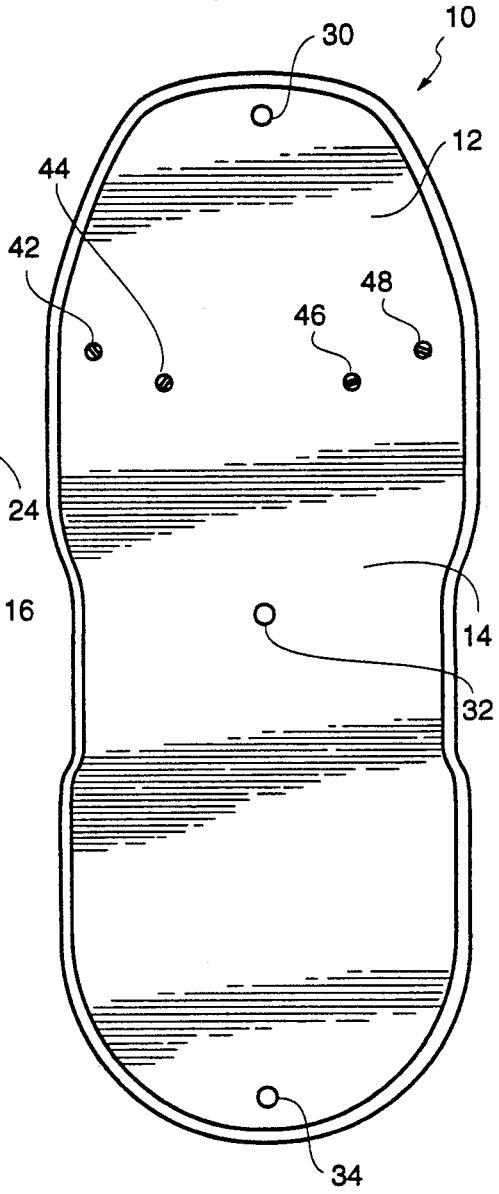
FIG. 4 of the drawings is a back plan view of the wall mounted skateboard storage rack of FIG. 1.

FIG. 4 is a back view of skateboard storage rack 10 and illustrates planar back surface 14 having a plurality of holes 30, 32, and 34 serving as ports for nails, screws, rivets, lugs, pins, or bolts to be inserted therethrough and into a wall to affix the base plate 12 to the wall. Screws 42, 44, 46, and 48 serve to connect support arms 24 and 22, respectively, to base plate 12.

As observed in FIGS. 1, 3, and 4 base plate 12 of storage rack 10 is shaped to correspond to a conventional design of a skateboard.

Figure 5:
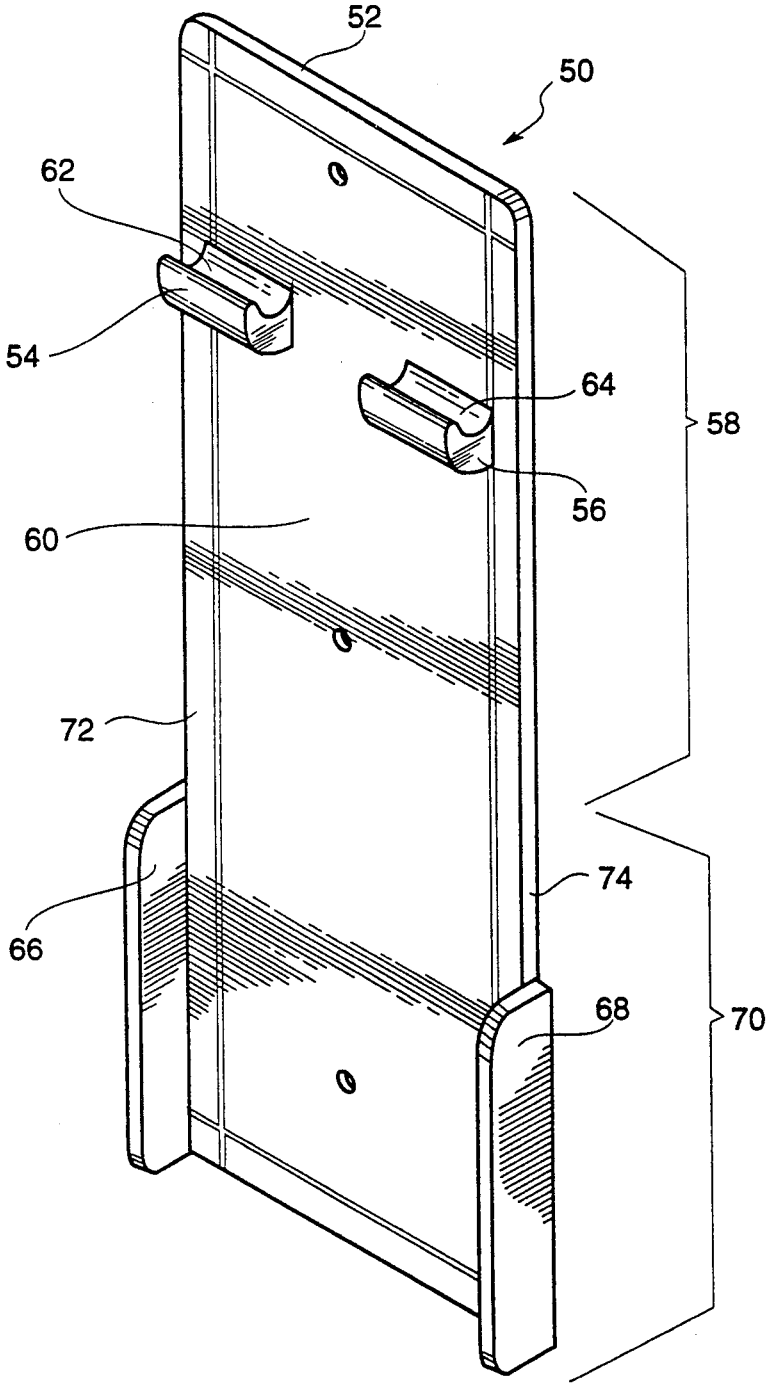
FIG. 5 of the drawings is a frontal perspective view of an alternative embodiment of the wall mounted skateboard storage rack of the present invention and shows a pair of skateboard wheel support arms located at an upper portion of a base plate and horizontally aligned from each other in spaced apart relation to receive and support one pair of wheels of a skateboard and guide members attached to the lower portion of the base plate to receive and secure therebetween the other pair of wheels of a skateboard.

FIG. 5 illustrates in frontal perspective view an alternative embodiment of the wall mounted skateboard storage rack of the present invention wherein storage rack 50 has a substantially rectangular-shaped base plate 52 having a pair of skateboard wheel support arms 54 and 56 located at upper portion 58 of front surface 60 of base plate 52 which are horizontally aligned from each other in spaced apart relation to receive and support a pair of wheels of a skateboard at concave wheel receiving upper surfaces 62 and 64 of skateboard wheel support arms 54 and 56 respectively. A pair of opposed guide members 66 and 68 are attached to base plate side surfaces 72 and 74 respectively of lower portion 70 of base plate 52 in horizontal alignment to each other and in spaced apart relation to receive and secure therebetween the remaining pair of wheels of a skateboard to thereby maintain the skateboard in substantial vertical alignment with base plate 52.

Although the preferred embodiments of the present invention have been disclosed and described in detail above, it should be understood that the invention is in not limited thereto, and its scope is to be determined by that of the following claims.

I claim:

1. A wall mounted skateboard storage rack comprising a base plate having a back planar surface and a front surface including an upper and lower portion, means for connecting said base plate to a wall, a pair of skateboard wheel support arms located at said upper portion of said base plate front surface and horizontally aligned from each other in spaced apart relation to receive and support a pair of wheels of a skateboard, and means for containing the skateboard in substantially vertical alignment with the base plate.

2. The wall mounted skateboard storage rack of claim 1 wherein the means for connecting said base plate to a wall comprises the base plate having a hole at a vertical center line of the base plate serving as a port for a nail, screw, rivet, lug, pin, or bolt to be inserted therethrough and into said wall to affix the base plate to said wall.

3. The wall mounted skateboard storage rack of claim 1 wherein the means for connecting said base plate to a wall comprises said base plate having a plurality of holes serving as ports for nails, screws, rivets, lugs, pins, or bolts to be inserted therethrough and into said wall to affix the base plate to said wall.

4. The wall mounted skateboard storage rack of claim 3 wherein the plurality of holes are vertically aligned along the horizontal center line of the base plate.

5. The wall mounted skateboard storage rack of claim 1 wherein the means for containing the skateboard in substantially vertical alignment with the base plate comprises a pair of guide members attached to said base plate in spaced apart relation at the lower portion thereof to receive and secure a pair of wheels of a skateboard therebetween.

6. The wall mounted skateboard storage rack of claim 1 wherein the means for containing the skateboard in substantially vertical alignment with the base plate comprises each of said skateboard wheel support arms having a brace surface at their outer side end.

7. The wall mounted skateboard storage rack of claim 5 wherein the guide members are horizontally aligned from each other in spaced apart relation to receive and secure a pair of wheels of a skateboard therebetween.

8. The wall mounted skateboard storage rack of claim 5 wherein the guide members are connected to the side surfaces of said base plate and project perpendicularly beyond the base plate front surface.

9. The wall mounted skateboard storage rack of claim 1 wherein each of skateboard wheel support arms have a concave wheel receiving upper surface.

10. The wall mounted skateboard storage rack of claim 1 wherein the base plate is substantially rectangular in shape.

* * * * *